United States Patent [19]

Köllner et al.

[11] Patent Number: 4,700,508

[45] Date of Patent: Oct. 20, 1987

[54] PANE GUIDE FOR AN AUTOMOBILE SLIDING WINDOW

[75] Inventors: Harald Köllner, Altenstadt; Georg Uhlig, Frankfurt am Main, both of Fed. Rep. of Germany

[73] Assignee: Rockwell Golde GmbH, Fed. Rep. of Germany

[21] Appl. No.: 944,131

[22] Filed: Dec. 22, 1986

[30] Foreign Application Priority Data

Jan. 9, 1986 [DE] Fed. Rep. of Germany ..... 3600413

[51] Int. Cl.[4] ..... E05F 11/48

[52] U.S. Cl. ..... 49/352; 49/374

[58] Field of Search ..... 49/352, 374, 375, 376, 49/360, 348, 349, 350, 351

[56] References Cited

U.S. PATENT DOCUMENTS 4,494,336 1/1985 Ishii et al. ..... 49/352

4,502,247 3/1985 Kobayashi et al. ..... 49/352

*Primary Examiner*—Philip C. Kannan

[57] ABSTRACT

In a pane guiding system for an automobile sliding window, a central guide rail, to be fixed to the bodywork, is provided, on flanges of which a support plate, connected both to the window pane and also to the force-transmitting element of a window winder, is slidably guided by slide elements fixed on the support plate. For compensating the movement clearance resulting from wear on the slide tracks, the flanges of the guide rail are of resilient construction, so that they bear virtually without play against the associated guide surfaces of the slide elements even after fairly long periods in operation.

8 Claims, 3 Drawing Figures

PANE GUIDE FOR AN AUTOMOBILE SLIDING WINDOW

BACKGROUND OF THE INVENTION

This invention relates to a pane guide for a sliding window which can be lowered into the window shaft of an automobile, especially a passenger vehicle.

DESCRIPTION OF PRIOR ART

Such a pane guide is known wherein a central guide rail, formed from a sheet metal profile and fixed to the automobile bodywork, is mounted so as to extend in the direction of movement of the window pane. Slide elements are disposed on the guide rail spaced from one another and are slidable on flanges of the guide rail which are orientated perpendicularly and parallel to the window pane, the slide elements being fixed to a support plate, which is connected with a force-transmitting element of a hand-operated or electric motor-operated window winder and with a lifting rail acting firmly on the lower edge of the pane for guiding the pane parallel to the direction of movement of the window pane. The slide elements each comprise two guide surfaces opposite and parallel to each other in pairs, the distance between which is invariable and which engage from both sides around the associated flanges of the guide rail.

In a known pane guide of this type (DE-PS 15 55 632), the slide elements are each formed in one piece of plastics material and are guided with their guide surfaces, the spacing between which is approximately equal to the sheet thickness of the guide rail, on the flanges of the guide rail. The known pane guide therefore operates with slide tracks, which are formed from the sheet metal thickness of the guide rail itself, with the result that the manufacturing tolerances depend basically only upon the fluctuations in the thickness of the sheet, which in commercially available sheets vary within very narrow limits. Since, also, the distance between the pair of guide surfaces of the slide elements can be easily manufactured with low tolerance range, the known pane guide offers a virtually play-free sliding guidance, which reliably prevents tilting and/or twisting of the window pane, which is frequently inadequately guided or not at all guided at its lateral edges, about one or more tilting or rotational axes.

The known pane guide, manufactured in large numbers, has proved excellent in practice. After long operating periods, i.e. excessive numbers of actuation movements especially under difficult conditions, however, in spite of the use of highly wear-resistant plastics as the slide element material, wear has on occasions become evident on the guide surfaces of the slide elements, thus adversely affecting the pane guidance, which initially was virtually free of play, and therefore the window pane condition.

It is therefore an object to achieve a guidance of the slide elements on the guide rail which remains virtually free of play even after long periods in operation.

SUMMARY OF THE INVENTION

According to the present invention there is provided a pane guide for a sliding window for an automobile, the guide comprising a central guide rail for fixing to the automobile bodywork in the intended direction of movement of the window pane, spaced apart slide elements slidably engaging on flanges of the guide rail so as to be orientated in use substantially perpendicularly and parallel to the window pane, which slide elements are fixed to a support plate, which is connected in use with a force transmitting element of a hand-operated or electric motor-operated window winder and with a lifting rail engaging firmly on the lower edge of the pane for the guidance of the pane parallel to the direction of movement of the window pane, and the slide elements each comprise two guide surfaces parallel and opposite to each other in pairs, the distance between which is invariable and which engage around the associated flanges of the guide rail from both sides, at least one of said flanges of the guide rail is bent back to form a resilient pressure strip in such a manner that two externally situated bearing surfaces associated with one pair of said guide surfaces are formed, of which one of said bearing surfaces situated on the pressure strip as viewed in cross-section and with the slide elements not mounted, converges with the other of said bearing surfaces towards the end of the flange at an acute angle, the pressure strip bearing resiliently, when the slide elements are mounted, with said one bearing surface against the associated guide surface, whereas said other bearing surface bears against the guide surface associated with it.

In order to achieve the elasticity provided in the region of the flanges of the guide rail, various forms of embodiment are proposed. According to one advantageous form of embodiment, it is provided that the pressure strip, as viewed in cross-section, shall adjoin the guide rail via a resilient bending zone, shaped generally as a cotter. By this measure, in the bending zone of the flanges of the guide rail, a spring behaviour sufficient for the desired compensation of wear is achieved, without a surface pressure contribution between guide surfaces and bearing surfaces that would lead to an unacceptable increase in the torque on the window winder drive required for moving the sliding window.

A further advantageous possible manner of achieving the desired spring behaviour consists in that the guide rail is weakened in the bending zone of the pressure strips. This means that the procedure of bending back the outer zones of the flanges can also be carried out with little force. Provision may advantageously be made here for forming at least two parallel grooves in the direction of the longitudinal axis of the guide rail on the inside in the bending zone, part of the bending-back taking place at each of these grooves. In any case, however, the bending-back in all forms of embodiment should be carried out in such a manner that the inner surfaces of the flange and of the pressure strip facing one another are at a distance apart which makes possible spring movements. The slide elements associated with the flanges of the guide rail constructed in this manner are advantageously so constructed that the guide surfaces, provided in pairs, are each formed by the lateral walls of a guide channel formed in the slide element, which guide channel is located, in the bending zone of the guide rail, at a distance from the guide rail. In this manner, defined guide surfaces are formed on the lateral walls of the guide channel, while the other wall regions of the guide channels do not bear against the guide rail.

With advantage, the slide elements engaging on the different flanges of the guide rail are combined in pairs into one piece.

BRIEF DESCRIPTION OF THE DRAWINGS

For a better understanding of the invention and to show how the same may be carried into effect, reference will now be made, by way of example, to the accompanying drawings, in which.

DETAILED DESCRIPTION OF PREFERRED EMBODIMENTS

Figure 1:
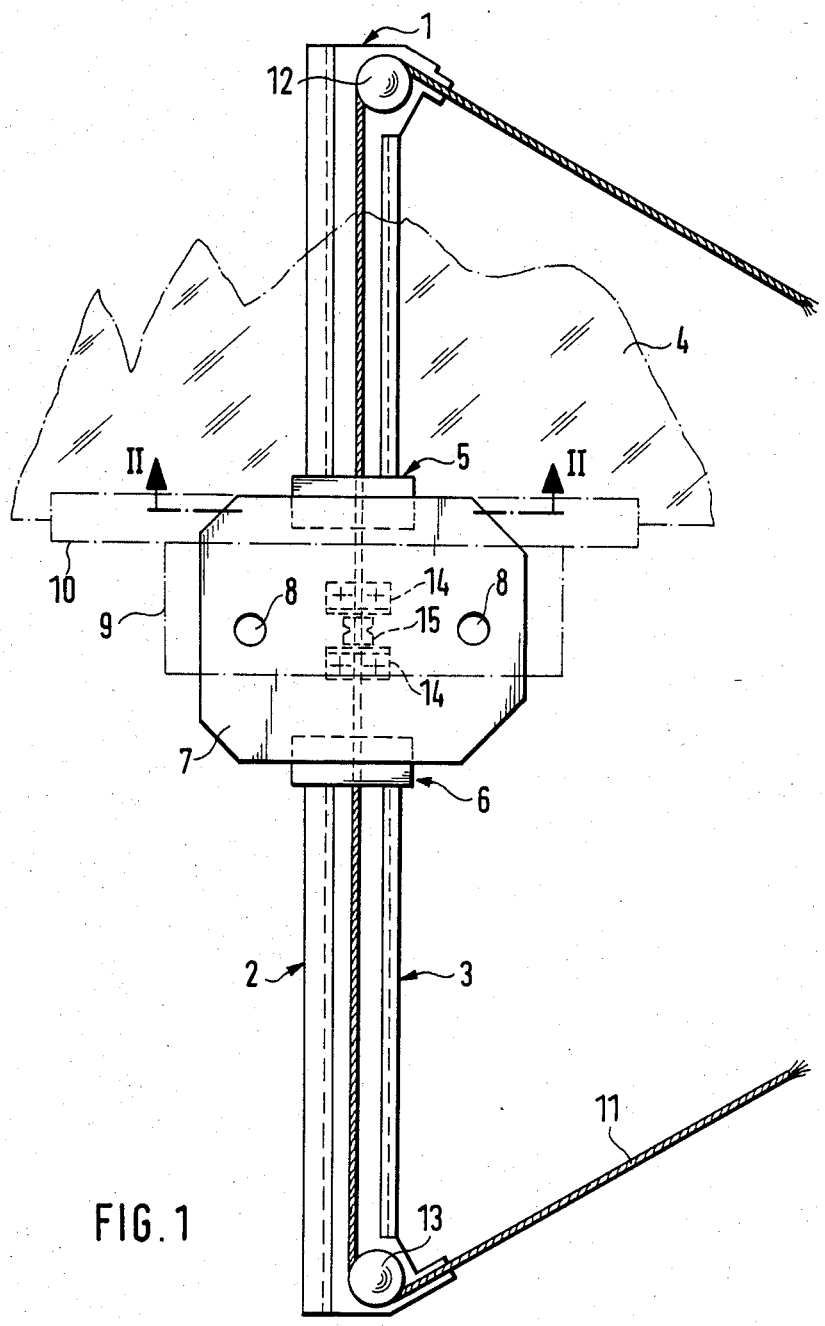
FIG. 1 is a diagrammatic front view of an automobile window pane guiding system.
Figure 2:
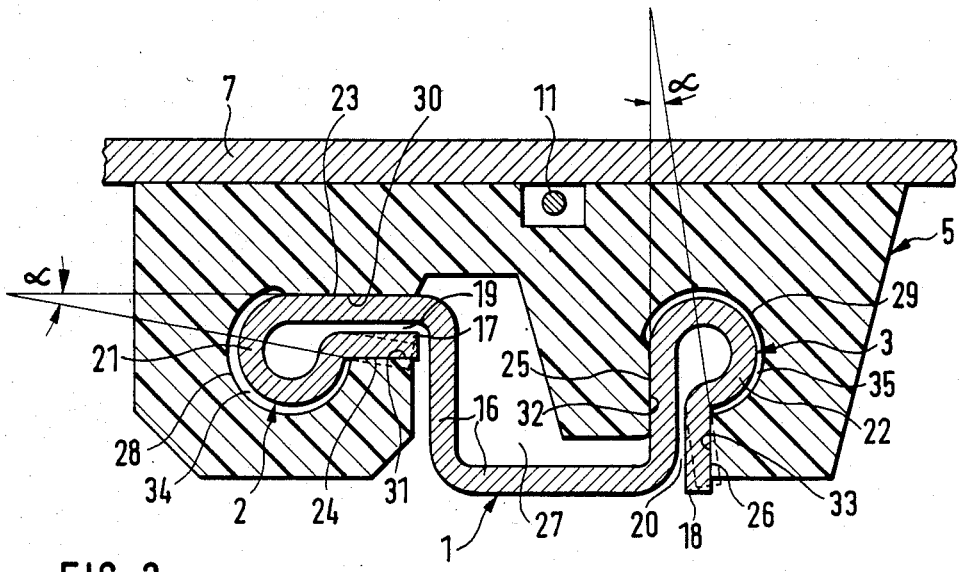
FIG. 2 is a partial section along the line II—II in FIG. 1, which shows a first form of guide rail.

In FIG. 1, a guide rail 1 is illustrated, which may be fixed, for example, to a door inner plate (not shown) of an automobile body, which guide rail is profiled from an elongate strip of metal, as seen in the cross-sectional view of FIG. 2, shown larger than actual size. The guide rail 1 possesses two flanges 2 and 3, to be explained later in respect of their form, of which the flange 2 is orientated substantially parallel to a window pane 4 partly indicated in FIG. 1 by dot-and-dash lines, whereas the flange 3 is orientated substantially perpendicularly to the window pane 4. On the flanges 2 and 3, two slide elements 5 and 6, spaced apart from each other, are slidably guided in a manner to be described, these slide elements each being constructed as one piece and rigidly fixed to a support plate 7 orientated parallel to the window pane 4. In the support plate 7, there are fixing bores 8 for connection of the support plate 7 to a lifting lug 9, shown in FIG. 1 in dot-and-dash lines, of a lifting rail 10 fixed to the lower edge of the window pane 4 and shown in FIG. 1 also in dot-and-dash lines.

The arrangement so far described with reference to the drawings can be combined with all known window winder systems. In the example illustrated, it is connected to a so-called cable window winder, a force-transmitting element of which, consisting of a wire cable 11, is firmly connected to the support plate 7 and guided around rollers 12 and 13, rotatably mounted at the ends of the guide rail 1, to drive apparatus, not shown here. For the fixing of the wire cable 11 to the support plate 7, two angle-section lugs 14, spaced apart from each other, are fixed to the support plate, a lead weight 15 secured to the wire cable 11 being held between these lugs.

It can immediately be seen from FIG. 1 that, when drive movements of the wire cable 11 in the one or the other direction occur, the support plate 7 and the components 9, 10, and 4 connected therewith are moved either downwards or upwards, the support plate sliding on the guide rail 11 accurately guided by means of the slide elements 5, 6.

The special construction of the guide rail 1 and the slide elements 5, 6 associated with it will now be described in more detail with reference to FIG. 2. This Figure shows a first embodiment of the guide rail 1, in which the flanges 2 and 3, bent at right angles from a right-angled profile 16, are bent back to form a resilient pressure strip 17, 18 respectively while leaving a gap 19, 20 respectively to permit spring movements. In this embodiment, the spring behaviour of the pressure strips 17 and 18 is achieved by generally cotter-shaped bending zones 21, 22 respectively on the flanges 2, 3 respectively.

On the flanges 2, 3, there are bearing surfaces 23, 24 and 25, 26 respectively, externally situated and serving for guiding the slide elements 5, 6. The bending-back is carried out in such a manner that, when the slide elements 5, 6 are not pushed onto the guide rail 1, the pressure strips 17, 18 are slightly sprung outwards, a small acute angle $\alpha$ being formed in each case between the bearing surfaces 23, 24 and 25, 26 respectively. The outwardly sprung position of the pressure strips 17, 18 is illustrated in FIG. 2 in broken lines, the size of the angle $\alpha$ being exaggerated. The springing-out of the pressure strips 17, 18 out of the working position illustrated in full lines in FIG. 2 need only be very small, because only wear clearances of the order of a few hundredths of a millimetre to at most a few tenths of a millimetre need to be compensated.

The slide elements 5, 6 possess a central opening 27, adapted for seating the angle profile 16, adjoined by back-cut guide channels 28 and 29, formed into the slide elements 5, 6, for seating the flanges 2, 3 respectively. The guide channels 28, 29 possess mutually parallel guide surfaces 30, 31 and 32, 33 respectively, facing towards the bearing surfaces 23, 24 and 25, 26 respectively of the guide rail 1. When the slide elements 5, 6 are pushed onto the guide rail 1, then due to the resilient pressure strips 17, 18, the bearing and guide surface pairs 23/30, 24/31, 25/32 and 26/33 are brought into areal contact, thus eliminating any play at the slide tracks of the guide rail 1 even after long periods of operation. The bearing surfaces 23 and 25 now bear against the associated guide surfaces 30, 32 respectively, while the bearing surfaces 24, 26 respectively situated on the pressure strips 17, 18 bear resiliently against the guide surfaces 31, 33 respectively associated with them.

As will be seen, the guide surface pairs 30, 31 and 32, 33 are each formed by the lateral walls of the guide channel 28, 29 respectively. In the bending zone 21, 22 of the flanges 2, 3 respectively, the guide channels are so shaped that gaps 34, 35 respectively exist between their wall and the external surfaces of the bending zones. This ensures that the guidance of the slide elements on the guide rail 1 actually takes place only in the region of the bearing and guide surfaces.

Figure 3:
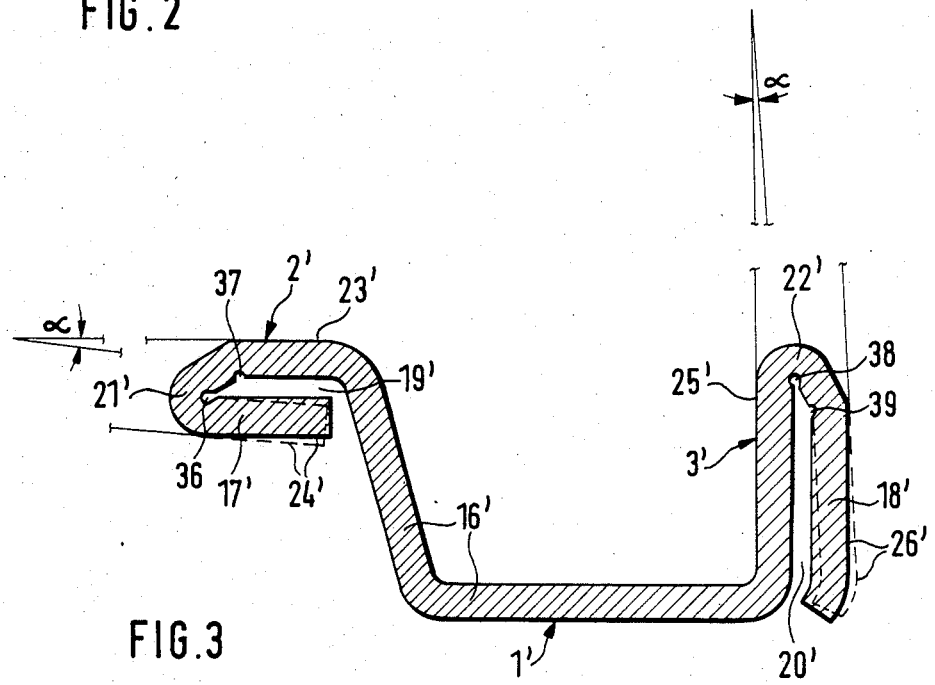
FIG. 3 is a section similar to FIG. 2 through a second form of the guide rail.

FIG. 3 shows a cross-section, to a larger scale than FIG. 2, through the second embodiment of the guide rail 1', with which are associated slide elements, not shown here but corresponding basically to the slide elements 5, 6 described with reference to FIG. 2. The guide rail 1' in turn has an angle profile 16', in this case of obtuse angle, adjoined by cranked flanges 2' and 3' which once again are so bent over that the flange 2' is substantially parallel to the support plate 7 and thus to the window pane 4, whereas the flange 3' is substantially perpendicular to the support plate 7 and therefore the window pane 4.

In this embodiment also, the flanges 2', 3', are bent back at their outer zones to form pressure strips 17', 18' respectively, leaving gaps 19', 20' respectively which permit spring movements of the pressure strips. The special feature consists, in this embodiment, in that the flanges 2', 3' in the bending zone 21', 22' respectively are weakened in their sheet thickness by two internally situated grooves 36, 37 and 38, 39 respectively, running parallel in the longitudinal direction of the guide rail 1', for facilitating the bending-over while at the same time improving the spring-back behaviour of the pressure strips 17' and 18' respectively. By these grooves, the bending-back of the pressure strips 17', 18' takes place by stages, the forming of the gaps 19' and 20' being at the same time facilitated.

In FIG. 3, the pressure strips 17', 18' are illustrated in full lines in the position which they adopt when the slide elements are pushed on, whereas their slightly outwardly sprung position again is shown in exaggerated form in broken lines. In the outwardly sprung position, the bearing surface pairs 23', 24' and 25', 26' again converge towards the edge of the relevant flange and form small acute angles $\alpha$.

In both the forms of embodiment described in FIGS. 2 and 3, the two flanges 2 and 3 or 2' and 3' respectively of the guide rail 1, 1' respectively are equipped with a resilient pressure strip 17, 18 and 17', 18' respectively, in order to bring about an automatic compensation of wear clearance. For specific applications, however, it may be sufficient for only one of the two flanges to be so formed, especially of course when the guide rail is equipped with only one guide flange.

In the form of embodiment illustrated and described in the drawings of the associated slide elements 5, 6, each slide element is formed in one piece, that is to say combines the individual slide elements associated with each flange 2, 3 into a one-piece slide element. It would, of course, be possible to provide separate slide elements for each flange 2, 3 or 2', 3' respectively, fixed to the support plate 7 in an appropriate manner. The slide elements can be injection-moulded from a suitable, wear-resistant plastics material, for example polyamide 6.

It will be appreciated that, as a result of the present construction, the bearing surfaces at each correspondingly constructed flange of the guide rail are in a resiliently prestressed contact with the two guide surfaces of the associated slide element, which contact is maintained over long operating periods by the spring behaviour of the pressure strip even when wear occurs at the guide surfaces and the bearing surfaces, with the result that the pane guiding system remains virtually free of play throughout the life of the automobile.

We claim:

1. A pane guide for a sliding window for an automobile, the guide comprising a central guide rail for fixing to the automobile bodywork in the intended direction of movement of the window pane, flanges on the guide rail, spaced apart slide elements slidably engaging on said flanges of the guide rail so as to be orientated in use substantially perpendicularly and parallel to the window pane, a support plate to which said slide elements are fixed, which is connected in use with a force transmitting element of a hand-operated or electric motor-operated window winder and with a lifting rail engaging firmly on the lower edge of the pane for the guidance of the pane parallel to the direction of movement of the window pane, and the slide elements each comprise two guide surfaces parallel and opposite to each other in pairs, the distance between which is invariable and which engage around the associated flanges of the guide rail from both sides, at least one of said flanges of the guide rail is bent back to form a resilient pressure strip in such a manner that two externally situated bearing surfaces associated with one pair of said guide surfaces are formed, of which one of said bearing surfaces situated on the pressure strip as viewed in cross-section and with the slide elements not mounted, converges with the other of said bearing surfaces towards the end of the flange at an acute angle, the pressure strip bearing resiliently, when the slide elements are mounted, with said one bearing surface against the associated guide surface, whereas said other bearing surface bears against the guide surface associated with it.

2. A pane guide according to claim 1, wherein the pressure strip, considered in cross-section, adjoins the remainder of the guide rail via a resilient, generally cotter-shaped bending zone.

3. A pane guide according to claim 1, wherein the guide rail is weakened in the bending zone of said as least one pressure strip.

4. A pane guide according to claim 3, wherein, in the bending zone, at least two parallel grooves are formed on the inside in the direction of the longitudinal axis of the guide rail, at each of which grooves the bending-back is partly carried out.

5. A pane guide according to claim 1, wherein said slide element forms a guide channel which is located in the bending zone of the guide rail and is spaced from the guide rail, and said paired guide surfaces are each formed by side walls of said guide channel.

6. A pane guide according to claim 1, wherein the slide elements engaging on different flanges of the guide rail are each combined in pairs as one piece.

7. A pane guide according to claim 1, wherein said central guide rail is formed from a sheet metal profile.

8. In an automobile, a pane guide for a sliding window for an automobile, the guide comprising a central guide rail fixed to the automobile bodywork in the intended direction of movement of the window pane, flanges on the guide rail, spaced apart slide elements slidably engaging on said flanges of the guide rail and orientated substantially perpendicularly and parallel to the window pane, a support plate to which said slide elements are fixed, which is connected with a force transmitting element of a hand-operated or electric motor-operated window winder and with a lifting rail engaging firmly on the lower edge of the pane for the guidance of the pane parallel to the direction of movement of the window pane, and the slide elements each comprise two guide surfaces parallel and opposite to each other in pairs, the distance between which is invariable and which engage around the associated flanges of the guide rail from both sides, at least one of said flanges of the guide rail is bent back to form a resilient pressure strip in such a manner that two externally situated bearing surfaces associated with one pair of said guide surfaces are formed, of which one of said bearing surfaces situated on the pressure strip as viewed in cross-section and with the slide elements not mounted, converges with the other of said bearing surfaces towards the end of the flange at an acute angle, the pressure strip bearing resiliently, when the slide elements are mounted, with said one bearing surface against the associated guide surface, whereas said other bearing surface bears against the guide surface associated with it.

* * * * *